US005104147A

United States Patent [19]

King

[11] Patent Number: 5,104,147

[45] Date of Patent: Apr. 14, 1992

[54] BINDER SYSTEM FOR DISPLAY BOOK AND THE LIKE

[75] Inventor: Michael J. King, Flossmoor, Ill.

[73] Assignee: U.S. Sample Company, Chicago, Ill.

[21] Appl. No.: 610,513

[22] Filed: Nov. 8, 1990

[51] Int. Cl.[5] ..... B42D 1/00

[52] U.S. Cl. ..... 281/21.1; 462/78

[58] Field of Search ..... 281/45, 21.1, 28; 462/71, 78, 75, 84

[56] References Cited

U.S. PATENT DOCUMENTS

| | | | |
|---|---|---|---|
| 2,772,494 | 12/1956 | Bishop . | |
| 2,857,696 | 10/1958 | Barrow . | |
| 3,298,374 | 1/1967 | Grundell | 281/45 |
| 3,367,049 | 2/1968 | Noreen . | |
| 3,530,984 | 9/1970 | Howard . | |
| 3,570,071 | 3/1971 | Wardell . | |
| 3,642,144 | 2/1972 | Brooks . | |
| 3,752,503 | 8/1973 | Holes et al. . | |
| 3,762,985 | 10/1973 | Chaitman . | |
| 3,768,838 | 10/1973 | Shibata . | |
| 3,797,795 | 3/1974 | Hemgren . | |
| 3,909,141 | 9/1975 | Staats . | |
| 3,965,583 | 6/1976 | Price . | |
| 4,138,143 | 2/1979 | Lawes . | |
| 4,147,257 | 4/1979 | Zippel . | |
| 4,180,341 | 12/1979 | Langhorst | 281/45 X |
| 4,187,630 | 2/1980 | Giulie et al. . | |
| 4,237,632 | 12/1980 | Segerstad . | |
| 4,292,749 | 10/1981 | Thomas . | |
| 4,430,015 | 2/1984 | Nerlinger . | |
| 4,524,992 | 6/1985 | Linn | 281/45 |
| 4,531,311 | 7/1985 | Howard et al. . | |
| 4,542,827 | 9/1985 | Pilzer . | |
| 4,566,211 | 1/1986 | Gustafson et al. . | |
| 4,601,489 | 7/1986 | Stancato . | |
| 4,698,928 | 10/1987 | Soporowski . | |
| 4,703,943 | 11/1987 | Zelenko et al. . | |
| 4,730,972 | 3/1988 | Sun et al. . | |
| 4,785,565 | 11/1988 | Kuffner . | |
| 4,904,104 | 2/1990 | Gloeckle | 281/45 X |

*Primary Examiner*—Timothy V. Eley
*Assistant Examiner*—Willmon Fridie, Jr.
*Attorney, Agent, or Firm*—Welsh & Katz, Ltd.

[57] ABSTRACT

A binder system for use as a display book or the like includes a flexible spine having a continuous uninterrupted outer surface and an oppositely facing inner surface on which is formed a plurality of longitudinal outwardly projecting male connector elements. A plurality of channel members are releasably mounted on the connector elements and support cover sheets and display pages. The spine facilitates application of indicia on its outer surface and enables opening of the binder to fully expose the display pages for observation.

13 Claims, 1 Drawing Sheet

BINDER SYSTEM FOR DISPLAY BOOK AND THE LIKE

BACKGROUND OF THE INVENTION

The present invention relates generally to binder systems for display books and the like, and more particularly to a novel binder system employing a flexible spine defining a substantially uninterrupted outer surface and having a plurality of connector elements projecting from an opposite surface for releasable attachment of channel members which support display pages and cover sheets.

It is a common practice to employ binders for retaining in generally book fashion individual sheets or pages on which are displayed products such as greeting cards, fabric samples and/or patterns, and carpet and wallpaper samples and the like. It is highly desirable that such binders secure the sheets or sample bearing pages in a manner enabling them to be selectively opened so as to fully expose the sheet or page under consideration. Examples of known binders, alternatively termed binder systems, include conventional three-ring loose-leaf binders wherein the sheets to be inserted into the binder have holes punched along one edge to receive the binder rings; plastic type spiral bindings having flexible arcuate fingers which extend through holes formed along an edge of the sheets or pages; and post-type binders wherein a plurality of metallic or plastic posts are secured in parallel spaced relation along a relatively rigid support spine and extend through corresponding holes formed along edges of the sheets or pages with a retaining bar being affixed to the free ends of the posts.

The known binder systems exhibit significant drawbacks. For example, loose-leaf binders generally have limited capacity, therefore making them inappropriate for binding a substantial number of product sample pages or the like in catalog form. When full, they also generally inhibit full opening of the sample bearing sheets or pages.

The plastic spiral-type binders also have inherent limitations in that the plastic spines have limited capacity for insert pages, generally require specialized machines to facilitate assembly with insert sheets or pages, and, depending upon the size of the finished bound volume, may also significantly inhibit opening of the pages to fully expose them for consideration.

A significant drawback in known post-type binders is that, once assembled, they virtually prevent disassembly and thus preclude interchangeability of the initially bound pages or sheets. They also require specialized assembly equipment, and inhibit opening of the pages to full flat positions for observation.

More recent binding systems, which find particular application in sample display books wherein the display pages may be relatively bulky and are periodically replaced or interchanged, provide a relatively rigid elongated spine adapted to have a plurality of individual pages or packets of pages attached thereto. Longitudinal slots or grooves are formed in the spine to receive male connectors formed directly along edges of the pages or on channel-like members to which are attached individual pages or sheets. See, for example, U.S. Pat. Nos. 2,127,619 (Rosenthal) and 3,353,844 (Staats).

Alternative binder systems which employ channel-like sheet or display card holders secured together in generally book-like fashion are disclosed in U.S. Pat. Nos. 3,793,758 and 4,949,997 (Champagne).

A significant disadvantage in all known prior binder systems, and particularly those employing an elongated spine to which a plurality of sheet or display card supporting channels or holders are releasably attached, is that the binder systems do not readily admit to opening of the various pages to lie in flat easily observable positions. Moreover, none of the known prior binder systems employ a spine which is both flexible so as to enable opening of the individual display pages or sheets to substantially flat open positions, and presents a continuous uninterrupted outer surface on which indicia may be directly printed or affixed so that the binder system and associated cover sheets may be coordinated to create an aesthetically pleasing book-like appearance.

SUMMARY OF THE INVENTION

One of primary objects of the present invention is to provide a novel binder system for use as a display book or the like and which overcomes the disadvantages exhibited by known prior binder systems.

A more particular object of the present invention is to provide a novel binder system for use as a display book or the like which includes a flexible spine having an uninterrupted outer surface and an inner surface defining a plurality of outwardly projecting connector elements facilitating releasable attachment of a plurality of display sheet support channels and end covers in a manner enabling hinged opening of the binder for selectively exposing the display sheets in a generally flat condition.

Another object of the present invention is to provide a novel binder system as described wherein the connector elements on the inner surface of the spine member comprise generally T-shaped male connectors extending parallel to the longitudinal axis of the spine and facilitating releasable attachment of channel members which, in turn, support sample or display sheets or pages so as to enable selective hinged opening of the binder to fully expose the display sheets.

A feature of the binder system in accordance with the invention lies in providing a substantially continuous uninterrupted outer surface on the flexible spine to enable application of indicia directly on the spine, thus allowing design coordination of the spine with front and back cover pages to establish an overall design scheme for the binder similar to a permanently bound book.

Another feature of the binder system in accordance with the present invention lies in the provision of an optional handle channel which facilitates attachment of a handle externally of the spine.

Further objects, features and advantages of the invention, together with the organization and manner of operation thereof, will become apparent from the following detailed description of the invention when taken in conjunction with the accompanying drawing wherein like reference numerals designate like elements throughout the several views.

DETAILED DESCRIPTION

Figure 1:
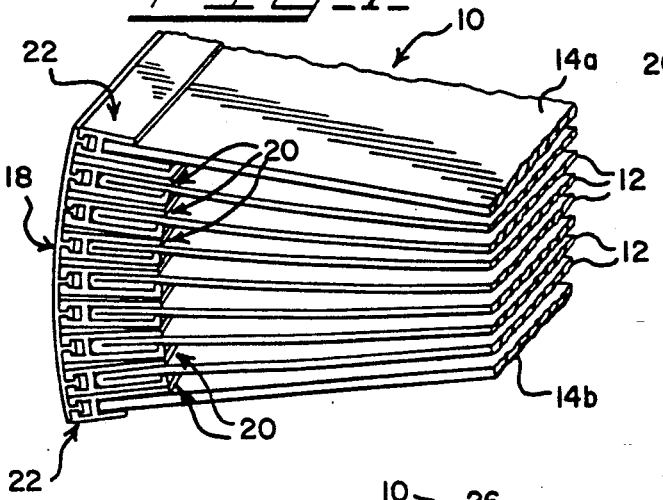
FIG. 1 is a fragmentary perspective view of a binder system constructed in accordance with the present invention, the binder and associated cover and display sheets lying in a generally horizontal position.
Figure 2:
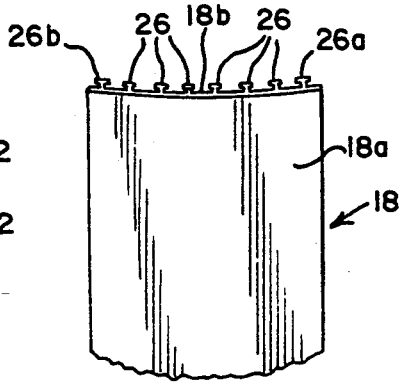
FIG. 2 is a fragmentary generally rear elevational view of the spine employed in the binder assembly of FIG. 1.

Referring to the drawing, a fragmentary portion of a binder system constructed in accordance with the present invention is indicated generally at 10 in FIG. 1. The binder system 10 finds particular application as a display book or the like wherein a plurality of display sheets or pages 12 are retained in generally book form between a pair of front and rear cover pages 14*a* and 14*b*, respectively. The display sheets or pages 12 are preferably made from paper or plastic of sufficient strength to support display samples thereon, such as greeting cards, wallpaper prints, carpet samples and/or patterns and other types of products which are generally presented in catalog form for review and selection by perspective purchasers. The front and back cover pages 14*a* and 14*b* may be made from relatively stiff heavy weight paper or plastic which facilitates printing and selective coloring for attractive marketing presentation of the products being displayed within the binder system.

Figure 3:
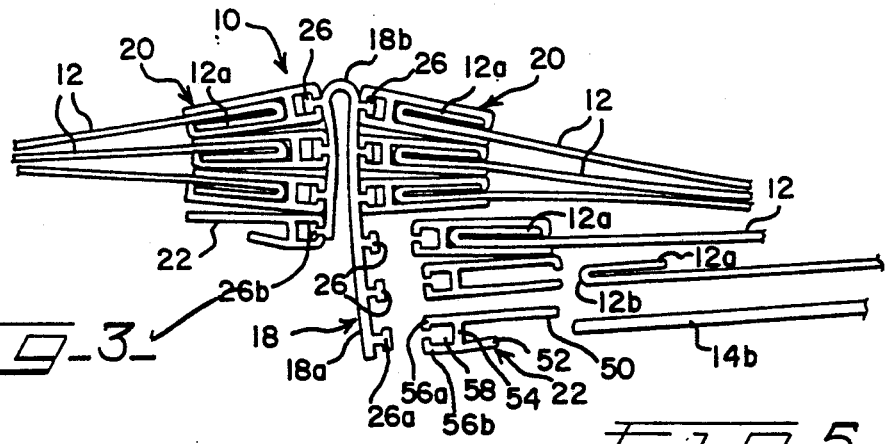
FIG. 3 is a fragmentary end view of the binder system of FIG. 1 but showing the binder and display pages in an open position and with various components disassembled for clarity.

Briefly, the binder system 10 includes a flexible spine 18 which facilitates releasable attachment of a plurality of substantially identical display page support channels 20 and a pair of identical cover page or end cover support channels 22. The display page support channels 20 and cover page support channels 22 are adapted to releasably support, respectively, the internal display pages 12 and the cover pages 14*a* and 14*b*, and are in turn adapted for releasable connection to the flexible spine 18. The spine 18 is bendable about an axis parallel to its longitudinal axis to facilitate selective opening of the display pages for full exposure, as illustrated in FIG. 3.

Turning now to a more detailed description of the binder system 10, the flexible spine 18 has greater longitudinal length than transverse width and is made of a suitable flexible plastic, such as polyvinyl chloride. One suitable material is vinyl plastic available from B. F. Goodrich as its GEON 6668. In the illustrated embodiment, the flexible spine 18 has a nominal thickness of approximately 0.060" and may have varying longitudinal length and transverse width depending upon the desired application for the binder system. The spine 18 has a continuous uninterrupted outer surface 18*a* which facilitates direct application of indicia thereon, such as by printing, silkscreen techniques or suitable label indicia. The plastic spine may be made from a colored plastic to coordinate with the overall design scheme for the binder system.

The spine 18 has an inner surface 18*b* on which is formed connector means in the form of a plurality of outwardly projecting connector elements 26. The connector elements 26, which may alternatively be termed male connectors, extend parallel to the longitudinal axis of spine 18 and are substantially equidistantly spaced across the transverse width of the spine. The connector elements 26 preferably extend along the full longitudinal length of the spine, but may be interrupted or segmented along the length of the spine if desired. In the illustrated embodiment, the outwardly projecting connector elements 26 take the form of generally T-shaped male connector elements. The male connector elements could alternatively take the form of generally cylindrical elongated beads which are affixed to the flexible spine through web or flange connections. As will become apparent, the parallel connector elements 26 are spaced apart sufficiently to facilitate connection of the display page support channels 20 and cover page support channels 22 to the connector elements in generally book form to enable opening of the cover and display pages to expose a selected display page as illustrated in FIG. 3.

The display page support channels 20 may be formed from a suitable plastic material by conventional plastic extruding techniques and extend the full longitudinal length of the spine 18. Each support channel 20 has a generally planar wall 30 to which is affixed a generally L-shaped wall 32 through a transverse web or flange 34. A free longitudinal edge 36 on the right-angle end flange 32*a* of wall 32 has a radius formed thereon and engages the wall 30 prior to attaching a display page to the support channel. Each support channel 20 thus defines a substantially rectangular channel 38 along its longitudinal length and is sufficiently flexible to enable a connecting edge on a display page 12 to be inserted into the channel between the walls 30 and 32, as will be described.

Figure 4:
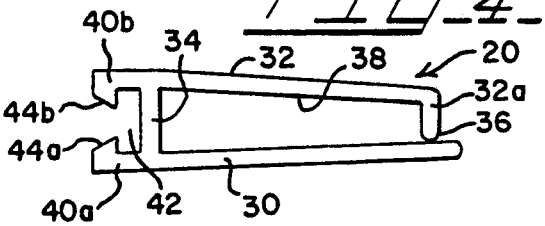
FIG. 4 is an end view, on an enlarged scale, of a display page support channel as employed in the binder system of FIG. 1.

Each display page support channel 20 has connector means formed along a longitudinal edge for connection with a selected one of the male connector elements 26 formed on the spine 18. As illustrated in FIG. 4, a pair of generally L-shaped connector flanges 40*a* and 40*b* are formed as integral extensions of the walls 30 and 32*b*, respectively, in opposite directions from the transverse web 34. The flanges 40*a* and 40*b* define a generally T-shaped connection channel 42 having an entry established between a pair of mutually facing inclined or beveled edge surfaces 44*a* and 44*b*. The flanges 40*a* and 40*b* and corresponding channel 42 are sized to enable the display page support channel 20 to be aligned over an end of a T-shaped male connector element 26 on the spine 18 and moved in generally longitudinal mutually telescoping relation so that the T-shaped connector element is received within the channel 42 as illustrated in FIGS. 1 and 3.

As aforedescribed, the binder system 10 includes a pair of cover page support channels 22 which are of substantially identical configuration and are releasably connected to the outermost longitudinal connector elements 26 on the flexible spine 18, such as indicated at 26*a* and 26*b* in FIG. 3. The cover page support channels 22 may be extruded from a suitable plastic so as to be relatively rigid but with limited flexibility, and have longitudinal lengths substantially equal to the longitudinal length of the spine 18. Each of the cover page support channels 22 has a generally planar inner wall 50 and an outer wall 52 which has a smaller transverse width than the corresponding inner wall and is interconnected to the associated inner wall through a web or flange 54. In the illustrated embodiment, the outer wall 52 is inclined toward the corresponding inner wall 50 so as to pinch against and frictionally retain a longitudinal edge of a cover sheet 14*a* or 14*b* inserted between the walls 50 and 52.

In similar fashion to the display page support channels 20, the cover page support channels 22 have a pair of substantially parallel longitudinally extending flanges 56*a* and 56*b* which are generally L-shape in transverse section and are formed as integral extensions of the walls 50 and 52, respectively. The flanges 56*a,b* cooperate with the web 54 to define a generally rectangular channel 58 having an entrance facilitating telescoping assembly over a corresponding one of the connector elements 26*a* and 26*b*.

As described, the display page support channels 20 are adapted to receive and retain longitudinal edges of the display sheets 12. To this end, each of the display sheets has a longitudinal edge folded back upon itself so as to form a retaining flange 12*a*. The lateral width of the retaining flange 12*a* is approximately equal to the major transverse dimension of the rectangular channel 38 within the display page support channel. In this manner, inserting a fold edge 12*b* of a display page 12 between the wall 30 and opposite right-angle wall 32*a* of an associated display page support channel causes the free edge of the retaining flange 12*a* to be captured by the right-angle wall 32*a* and thereby retain the display page in assembled relation with its support channel. Thereafter, should it become desirable to replace or otherwise remove a display page from its associated support channel, relative longitudinal movement between the support channel and the associated display page is necessary to release the display page.

Figure 5:
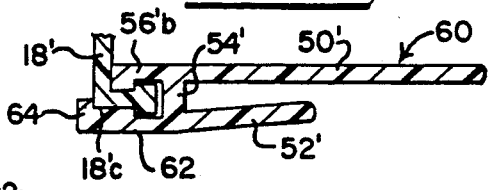
FIG. 5 is a transverse sectional view of an alternative cover sheet support channel shown connected to a longitudinal edge of the flexible spine.

FIG. 5 illustrates an alternative embodiment of a cover page support channel, indicated generally at 60. The cover page support channel 60 is substantially identical to the cover page support channels 22 but has an extended outer wall 62 having an L-shaped outer retaining lip 64 adapted to fit around a corner edge 18′*c* on a flexible spine 18′ which is otherwise substantially identical to the flexible spine 18.

Figure 6:
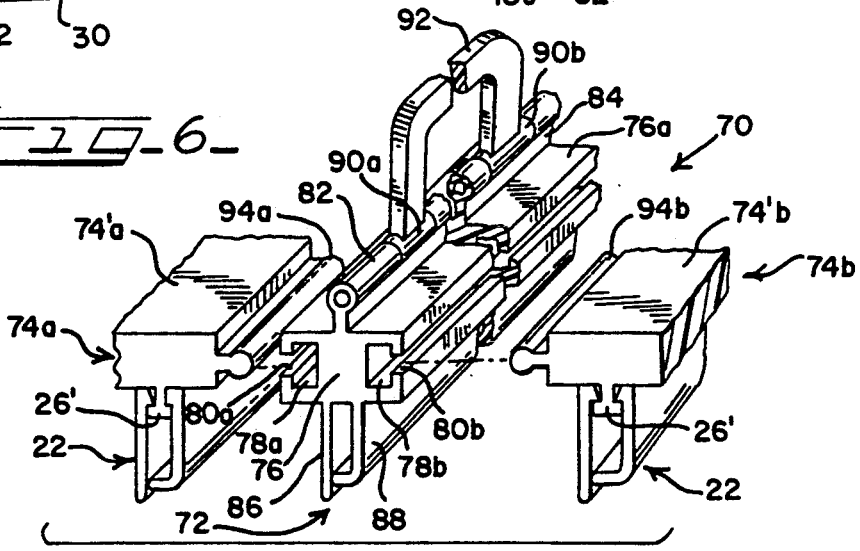
FIG. 6 is a fragmentary exploded perspective view illustrating an alternative binder system facilitating attachment of a handle externally of the spine.

FIG. 6 illustrates in an exploded perspective view a fragmentary portion of an alternative binder system, indicated generally at 70, which employs an elongated spine channel 72 to which is secured a pair of substantially identical flexible spine segments 74*a* and 74*b*. The spine channel 72, which may alternatively be termed a handle support channel, is made from a suitable extruded plastic material similar to the display page support channels 20, and includes a channel body 76 in which is formed a pair of laterally opposite longitudinal channels 78*a* and 78*b* which are rectangular in transverse cross section and are accessible through longitudinally extending slots 80*a* and 80*b*, respectively, formed in channel body 76. The spine channel 72 has a longitudinal length equal to the desired longitudinal length of the binder system spine. In the illustrated embodiment, the spine body 72 has a tubular handle support sleeve 82 suitably affixed to or formed integral with the spine body 76 through a web 84 so that the handle support sleeve is spaced outwardly from and extends generally parallel to the longitudinal axis of the spine body. A generally planar wall 86 and an L-shaped wall 88 are formed integral with the spine body 76 so as to extend from the spine body opposite the handle support sleeve 82 and along the full longitudinal length of the spine channel. The walls 86 and 88 establish means for releasably retaining a display sheet, such as the aforedescribed display sheet 12, in similar fashion to the display page support channels 20.

The handle support sleeve 82 is interrupted along its length to receive a pair of similar diameter handle sleeves 90*a* and 90*b* which are fixed to opposite ends of a handle 92. With the sleeves 82, 90*a* and 90*b* in coaxial relation, a hinge pin may be inserted through the aligned sleeves to hingedly secure the handle 92 to the spine channel 72 and thereby facilitate handling of the binder system 70.

In the embodiment illustrated in FIG. 6, the flexible spine segments 74*a* and 74*b* are similar to the aforementioned flexible spine 18 except that they each include a male coupling element, indicated at 94*a* and 94*b*, respectively, adapted to be inserted longitudinally into the channels 78*a* and 78*b* in the spine channel body 76. The coupling elements 94*a* and 94*b* and their respective spine segments are configured so that when the coupling elements 94*a* and 94*b* are assembled within the corresponding channels 78*a* and 78*b*, outer uninterrupted surfaces 74′*a* 74′*b* on the spine segments 74*a* and 74*b* are substantially coplanar with the outer surface 76*a* of the spine channel body 76. With the spine segments 74*a* and 74*b* being thus assembled with the spine channel 72, a plurality of outwardly projecting male connector elements 26′ formed on the inner surfaces of the spine segments 74*a* and 74*b* are adapted to have display page or cover page support channels 20 and 22 releasably secured thereto so that their respective display page receiving channels are parallel to and generally coplanar with the support channel of the spine channel 72, thereby enabling insertion of insert pages or end cover pages in a manner to create a book-type binder assembly similar to the aforedescribed binder assembly 10.

With the various embodiments of a binder system as illustrated and described, it is seen that a binder system is provided that includes a flexible spine which may be colored to coordinate with the cover pages and which has a substantially continuous uninterrupted outer surface upon which indicia may be printed, silk screened or otherwise applied by label or the like to achieve a desired overall color scheme and visual appearance of the resulting binder system. The binder system of the invention has particular advantages in marketing products wherein samples are conventionally presented on display pages in a binder system and are viewed by prospective purchasers. The aforedescribed flexible spines and associated display and cover page support channels facilitate easy opening to selectively fully expose the internal display pages.

While preferred embodiments of the present invention have been illustrated and described, it will be understood to those skilled in the art that changes and modifications may be made therein without departing from the invention in its broader aspects. Various features of the invention are defined in the following claims.

What is claimed is:

1. A binder system for use as a display book or the like comprising a flexible elongated spine having a continuous substantially uninterrupted outer surface and an oppositely facing inner surface, a plurality of elongated male connector elements fixed to said inner surface and projecting outwardly therefrom, said connector elements extending longitudinally of said spine being disposed substantially parallel to the longitudinal axis of said spine, and a plurality of channel support members adapted for releasable connection to individual ones of said male connector elements, each of said channel support members including means to support a display page or the like, said spine being selectively bendable about its longitudinal axis to enable substantially full exposure of said display pages for observation thereof.

2. A binder system as defined in claim 1 wherein said spine has substantially greater longitudinal length than transverse width.

3. A binder system as defined in claim 2 wherein said spine has a relatively thin transverse profile thickness.

4. A binder system as defined in claim 1 wherein said male connector elements extend the full longitudinal length of said spine.

5. A binder system as defined in claim 4 wherein said male connector elements define elongated enlarged outer ends each of which is adapted for mutually cooperating releasable attachment to a corresponding one of said channel members.

6. A binder system as defined in claim 5 wherein said male connector elements are generally T-shaped in transverse cross sectional configuration, said channel support members having channel grooves formed along their longitudinal lengths to receive said T-shaped male connector elements in mutual telescoping relation.

7. A binder system for use as a display book or the like comprising a flexible spine having a continuous substantially uninterrupted outer surface and an oppositely facing inner surface, a plurality of male connector elements fixed to said inner surface and projecting outwardly therefrom, said connector elements being disposed substantially parallel to the longitudinal axis of said spine, a plurality of channel support members adapted for releasable connection to said male connector elements and each including means for supporting a display page or the like when affixed to said flexible spine, and a pair of channel support members adapted for connection to the laterally outermost ones of said male connector elements on said spine for supporting cover pages, said spine being selectively bendable about its longitudinal axis to enable substantially full exposure of said display pages for observation thereof.

8. A binder system for use as a display book or the like comprising a flexible spine having a continuous substantially uninterrupted outer surface and an oppositely facing inner surface, a plurality of male connector elements fixed to said inner surface and projecting outwardly therefrom, said connector elements being disposed substantially parallel to the longitudinal axis of said spine, a plurality of channel support members adapted for releasable connection to said male connector elements, each of said channel support members including means to support a display page or the like, said spine including two flexible spine segments, and a spine channel interconnected to longitudinal edges of said two spine segments, said spine channel having means thereon enabling pivotal attachment of a handle such that the handle extends outwardly from said spine, said spine being selectively bendable about its longitudinal axis to enable substantially full exposure of said display pages for observation thereof.

9. A binder system as defined in claim 1 wherein said spine and channel support members are made from plastic.

10. A binder system for use as a display album or the like comprising a flexible elongated spine having a continuous substantially uninterrupted outer surface and an oppositely facing inner surface, a plurality of elongated male connector elements fixed to said inner surface and projecting outwardly therefrom, said connector elements each extending longitudinally of said spine and being disposed substantially parallel to the longitudinal axis of said spine, each of said connector elements having a longitudinal web portion connected along one edge to said spine and connected along an opposite edge to an enlarged connector portion, and a plurality of support members adapted for releasable connection to individual ones of said male connector elements, each of said support members being operative to support a display page or the like, said spine being selectively bendable about its longitudinal axis to enable substantially full exposure of said display pages for observation thereof.

11. A binder system as defined in claim 10 wherein said male connector elements are generally T-shaped in transverse cross-sectional configuration, each of said connector elements having a web portion connected along one edge to said spine, and connected along an opposite parallel edge to an associated transverse connector flange, said support members each being releasably operable with a corresponding transverse connector flange to facilitate mounting of said support members on said spine.

12. A binder system as defined in claim 10 wherein said enlarged connector portions of said male connector elements comprise generally cylindrical elongated beads each of which is affixed to a corresponding one of said longitudinal web portions.

13. A binder system as defined in claim 10 wherein said spine is made from plastic.

* * * * *